US008267032B2

(12) United States Patent
Zou

(10) Patent No.: US 8,267,032 B2
(45) Date of Patent: Sep. 18, 2012

(54) DUAL COLUMN SEMISUBMERSIBLE FOR OFFSHORE APPLICATION

(76) Inventor: Jun Zou, Katy, TX (US)

( * ) Notice: Subject to any disclaimer, the term of this patent is extended or adjusted under 35 U.S.C. 154(b) by 0 days.

(21) Appl. No.: 11/942,728

(22) Filed: Nov. 20, 2007

(65) Prior Publication Data

US 2009/0114139 A1 May 7, 2009

Related U.S. Application Data

(60) Provisional application No. 60/860,008, filed on Nov. 20, 2006.

(51) Int. Cl.
*B63B 35/44* (2006.01)

(52) U.S. Cl. ..... 114/266; 405/224

(58) Field of Classification Search ..... 114/264, 114/265, 266, 267, 260; 405/203, 204, 205, 405/206, 207, 208, 209, 223.1, 224
See application file for complete search history.

(56) References Cited

U.S. PATENT DOCUMENTS 3,976,021 A * 8/1976 Blenkarn et al. ..... 405/208
3,986,471 A * 10/1976 Haselton ..... 114/265
3,996,755 A * 12/1976 Kalinowski ..... 114/265
4,702,648 A * 10/1987 Stageboe et al. ..... 405/224
4,909,174 A * 3/1990 Bowes ..... 114/265
4,987,846 A * 1/1991 Yamashita et al. ..... 114/265
6,447,208 B1 * 9/2002 Huang et al. ..... 405/224
6,503,023 B2 * 1/2003 Huang et al. ..... 114/264
6,997,132 B2 * 2/2006 Steen ..... 114/265
7,033,115 B2 * 4/2006 Huang et al. ..... 114/264

* cited by examiner

*Primary Examiner* — Lars A Olson
(74) *Attorney, Agent, or Firm* — Buskop Law Group, PC; Wendy Buskop

(57) ABSTRACT

A dual column semisubmersible floating platform for use in offshore applications has a hull configuration including vertical support columns, pontoons connecting the lower ends of the vertical support columns by way of the connecting nodes, and a deck structure supported at an upper end of the columns. The vertical columns are arranged in pairs with one of the pair of vertical columns disposed a distance outward from the second of the pair. Arranging the columns in pairs provides for improved motions, more efficient deck structures and an improved opportunity to optimize the overall system for a particular application. The dual column semisubmersible can support offshore hydrocarbon drilling and production, including the use of wet trees or dry trees for hydrocarbon production. Risers can be supported on the pontoon and extended to the deck, and the structure can be anchored by mooring lines extending along the outboard face of the outboard columns extending radially outward and downward from their lower ends.

25 Claims, 12 Drawing Sheets

TRUSS SPAR

SECTION "A-A" VIEW

SECTION "A-A" VIEW

DUAL COLUMN SEMISUBMERSIBLE FOR OFFSHORE APPLICATION

CROSS REFERENCE TO RELATED APPLICATIONS

This application claims the benefit of U.S. Provisional Application No. 60/860,008, Nov. 20, 2006.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING

Not Applicable

BACKGROUND OF THE INVENTION

1. Field of the Invention

This invention relates to floating offshore oil and gas production and drilling facilities in general and particularly with semisubmersible hull forms for deep and ultra deep water, wet tree and dry tree applications. This invention relates generally to floating offshore applications, including applications outside the offshore oil and gas industry.

2. Description of the Prior Art

Many substructures have been described in the prior art with applicability to offshore oil and gas drilling and production. The preferred substructure provides efficient and economical support to the drilling and production facilities, minimal motions to maximize the availability of drilling and production operations and to minimize damage to components both located on the substructure and hanging off the substructure, and requires few complex operations for fabrication, assembly and installation.

The following list provides a brief description of some of the existing substructures used for offshore applications.

1) Conventional Semisubmersible

A conventional semisubmersible hull form consists of a number of columns and pontoons as illustrated in FIG. 1A. A typical spread mooring system is employed for station keeping. The first conventional semisubmersible was built in 1975. One of the limitations of a conventional semisubmersible is that the substructure exhibits large motions in storm conditions which makes it not suitable for dry tree production applications and marginal for wet tree production applications using steel catenary risers.

2) Deep Draft Semi-submersible (DDS)

Similar to conventional semisubmersibles, a DDS is composed of a number of columns and pontoons with deeper design drafts to improve the platform motion characteristics, as shown in FIG. 1B. The design draft of a DDS is typically around 100 ft or more. A spread mooring system is often used for station keeping. The DDS has been built for wet tree production applications. However, no DDS has been installed for dry tree production applications. The DDS has improved motions over a conventional semisubmersible, but the motions still limit applicability and negatively impact drilling and production operations.

3) Adjustable-Base Semisubmersible (ABS)

The adjustable-base semisubmersible is another hull form concept that has been proposed to further improve the platform motion characteristics to satisfy the requirements of dry tree production. A typical ABS concept is shown in FIG. 1C. The ABS design draft is typically about 250 ft. The ABS employs large moving components that are subjected to significant forces from wind, waves and current. The complexity of large moving components reduces the efficiency (weight and cost) of these concepts.

4) Truss Spar

The truss spar is a deep draft floating platform with a hull length of around 600 ft or more. The spar hull consists of three portions: 1) an upper buoyant structure to provide the necessary buoyancy, 2) a keel structure that holds solid ballast for improved stability and motions, and 3) a truss structure that rigidly connects the keel structure to the upper buoyant structure. A sketch showing a typical truss spar is illustrated in FIG. 1D. The truss spar is suitable for wet and dry tree offshore oil and gas production but requires offshore assembly due to the very deep draft.

5) Tension Leg Platform (TLP)

The TLP is another substructure with a history of both wet tree and dry tree production applications. A TLP hull form is composed of a number of vertical columns and horizontal pontoons vertically moored to the sea bed by a number of tendons as shown in FIG. 1E. Due to the vertical restraint of the tendons, the TLP virtually has no vertical dynamic movement. However, the tendon system significantly reduces the efficiency of the structure in very deep water, especially for larger payloads.

Although there are several existing substructure designs that are used for offshore applications, each of the existing designs has limitations that increase complexity or reduce efficiency, thereby increasing the cost and risk associated with implementation. A partial listing of the undesirable characteristics of the existing technology for wet tree and dry tree production facilities for offshore application is given below.

1) Conventional Semisubmersible—While conventional semisubmersibles have acceptable motion responses in normal weather, their motion responses during severe storm conditions are typically excessive and unacceptable for some applications. Specifically, vertical motions (heave) are too large for dry tree operations and limit operability for drilling operations.

2) Deep Draft Semisubmersible—Similar to the conventional semisubmersible, vertical motions (heave) are too large for dry tree operations using existing riser tensioning equipment.

3) Conventional Semisubmersible, Deep Draft Semisubmersible, and TLP—Surge motion can generate unacceptable fatigue damage for steel catenary risers, particularly those with large diameter and/or high pressure, high temperature and sour service application.

4) Deep Draft Semisubmersible—Design efficiency is limited by the conflicting requirements of minimizing deck span between columns versus in-place and pre-service stability requirements, which require increased distance between columns.

5) Adjustable-Base Semisubmersible—The connection design between the main hull and the extended base structure requires complex and unproven adjustable mechanisms which must withstand large loads, fatigue loads, and long platform life.

6) Truss Spar—High cost associated with construction, transportation and offshore integration. Deck structure with production facilities must be installed offshore using a very limited class of heavy-lift construction vessels and operations that are subject to potential delays due to weather sensitive operations.

7) TLP—High cost associated with vertical mooring system for ultra deepwater applications.

Suitable deepwater floating production platforms for the offshore oil industry are needed to permit the economical development of petroleum reserves in the increasingly deep waters in which fields are being located.

Prior art for improvements to the semisubmersible substructure include the addition of heave damping plates (Sarwe, U.S. Pat. No. 4,823,719), the use of multiple structures that must be joined offshore (Wetch, U.S. Pat. No. 6,666,624), movable components that must be extended by jacking or ballasting (Merchant, et al, U.S. Pat. No. 7,219,615) combinations of semisubmersible substructures with tension leg substructures using complex guides and mechanisms (Goldman, U.S. Pat. No. 4,995,762), introduction of a column belt in the vicinity of and across the water surface (Yamashita et al., U.S. Pat. No. 4,987,846), or motion reduction by increasing damping through prescribed pontoon geometry (Bowes, U.S. Pat. No. 4,909,174). Another semisubmersible concept (Wybro, U.S. Pat. No. 7,140,317) seeks to simplify construction by using a unitized central-pontoon structure located inboard of the columns. This central-pontoon concept reduces support spans for the pontoon but does not improve support of the deck structure. The central-pontoon concept also discloses vertical columns of rectangular cross section that have the major axis oriented radially outward from the center of the hull and therefore reduces the support spans and cantilevers of the deck structure. However, this feature requires elongating the column rectangular cross section to reduce the deck support span and there are practical limits to this approach. The present invention instead provides column pairs that can be square, rectangular or circular and still reduce the deck support spans as disclosed further in this specification.

The primary objective is to develop an offshore substructure with motions suitable for dry tree support or improved drilling operations. All of these and similar proposals for semisubmersible substructures suffer from one or more of the limitations provided above, either not achieving the desired motions or being overly complex such that fabrication and installation carry too much cost and/or risk. Economic constraints require that the production platform have an efficient design that is installable in a completed condition on location in deep water at an affordable cost. The current platform designs, while adequate in some respects, are sufficiently expensive that many production fields are not developed.

The objectives of the present invention are

1) To present a semisubmersible substructure that has the ability to de-couple constraints on column spacing due to deck support requirements from the constraints on column spacing due to overall platform stability, which will subsequently allow the designer to minimize platform motion responses by optimizing the overall platform configuration;
2) To present a semisubmersible substructure that has sufficiently small motion characteristics suitable for both wet tree and dry tree production applications, including applications utilizing top-tensioned risers;
3) To present a semisubmersible substructure that has sufficiently small surge motion characteristics to be compatible with large diameter steel catenary risers, particularly in high pressure, high temperature and/or sour service design conditions and even for water depths less than 4,000 ft;
4) To present a semisubmersible substructure that can be fully integrated quayside prior to offshore installation to minimize the cost and risk associated with offshore construction and commissioning operations;
5) To present a semisubmersible substructure that is composed of conventional structural components and concepts and without the use of complicated adjustable mechanisms;
6) To present a semisubmersible substructure that utilizes conventional constructability concepts and draft requirements compared to truss spars and deep-draft semisubmersibles;
7) To present a semisubmersible substructure that accommodates a conventional center well bay design and conventional drilling and riser support equipment for reliable drilling and riser operations; and
8) To present a semisubmersible substructure with virtually no limiting water depth constraints and which therefore can be employed in ultra deep water depths of 10,000 ft or beyond.

BRIEF SUMMARY OF THE INVENTION

This invention is a dual column semisubmersible floating platform for use in offshore applications and is configured to include vertical columns, pontoons connecting the lower ends of the vertical columns by way of the connecting nodes, and a deck structure supported at an upper end of the columns. The vertical columns are arranged in pairs to provide for improved motions, more efficient deck structures and an improved opportunity to optimize the overall system for a particular application. The invention can be used for offshore oil and gas production utilizing any combination of wet or dry trees.

BRIEF DESCRIPTION OF THE DRAWINGS

In order to better illustrate the invention and the advantages listed above, the following drawings and descriptions are provided.

DETAILED DESCRIPTION OF THE INVENTION

Figure 1A:
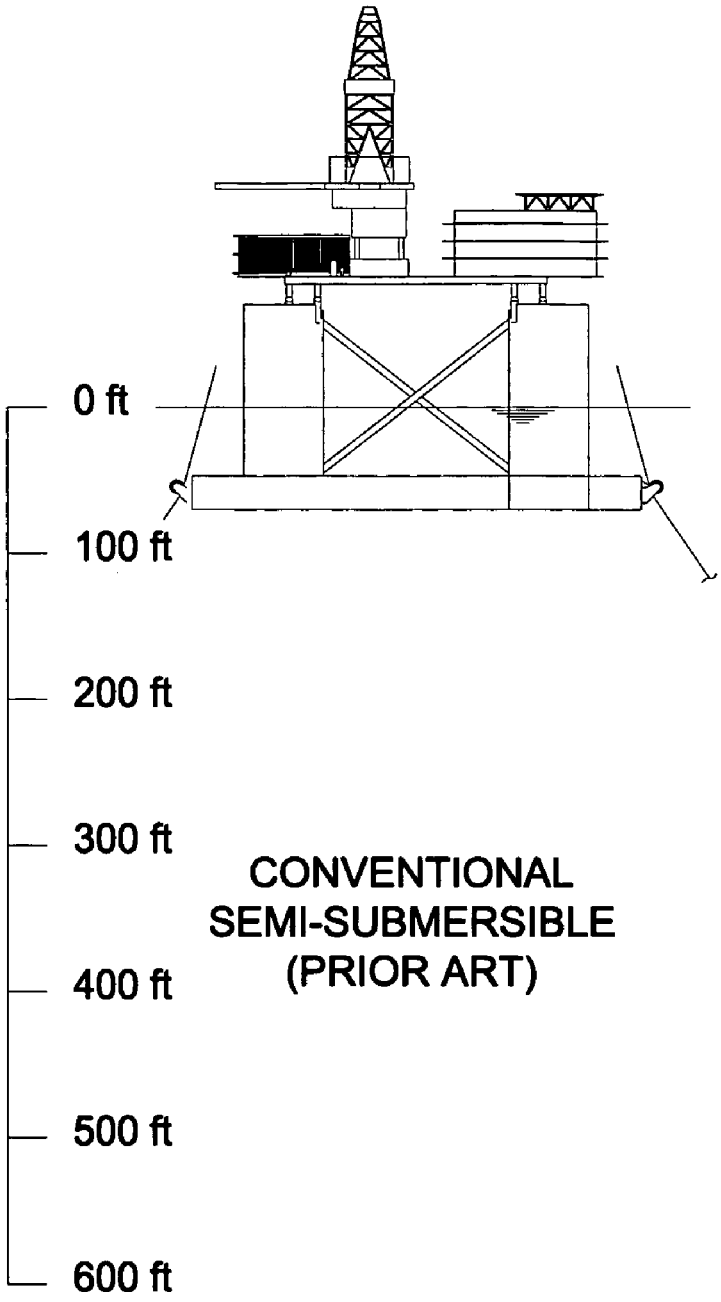
FIG. 1 presents several typical floating structures of prior art for wet tree and dry tree applications, including the conventional semisubmersible, the deep draft semisubmersible, the adjustable base semisubmersible, the tension leg platform and the truss spar.

Referring to FIGS. 2 through 5 and 7, one preferred embodiment 10 of the present invention consists of the following components:

four inner columns 11, four pontoons 12, four outer columns 13, four connecting nodes 14, column connection structure 15 connecting the inner and outer columns, and four column pairs 29, each consisting of one inner column 11 and one outer column 13, and arranged around the central vertical axis 24 of the substructure.

The inner columns 11 provide support to the deck structure 17 in addition to providing buoyancy and stability for the platform. The pontoons 12 connect the column pairs 29 at their lower ends by way of the connecting nodes 14, and also provide buoyancy for the platform. The outer columns 13 provide additional stability and buoyancy for the platform and help with hydrodynamic force cancellation due to pairing with the inner column. The outer columns can be used to support the deck structure or the deck may be clear of the upper end of the outer columns such that there is no connection. Having the upper portion of the outer column clear of any obstruction from or connection to the deck has some advantages with regards to crane access to the top of the outer column and no constraints on the placement or height of equipment located on the top of the outer column such as mooring equipment.

A ring type keel plate 16 located at the keel level and mounted at the inner side of the pontoons 12 is an optional feature that can be included depending on the metocean criteria of the application region. For example, in the long swell period regions such as offshore West of Africa and Brazil, adding a keel plate can increase the heave natural period and system heave damping to reduce heave motions.

The inner columns 11, outer columns 13 and pontoons 12 and connecting nodes 14 can be of any geometric shape, such as square, rectangular, round, and multi-sided. The preferred embodiment of the substructure 10 shown in FIGS. 2, 3, 5 and 7 includes four inner columns and four outer columns; however, the number of inner and outer columns will vary according to design requirements. The inner and outer columns can be vertical or inclined. In addition, the top of the outer column can be higher or lower than the top of the inner column depending on the design considerations.

Figure 2:
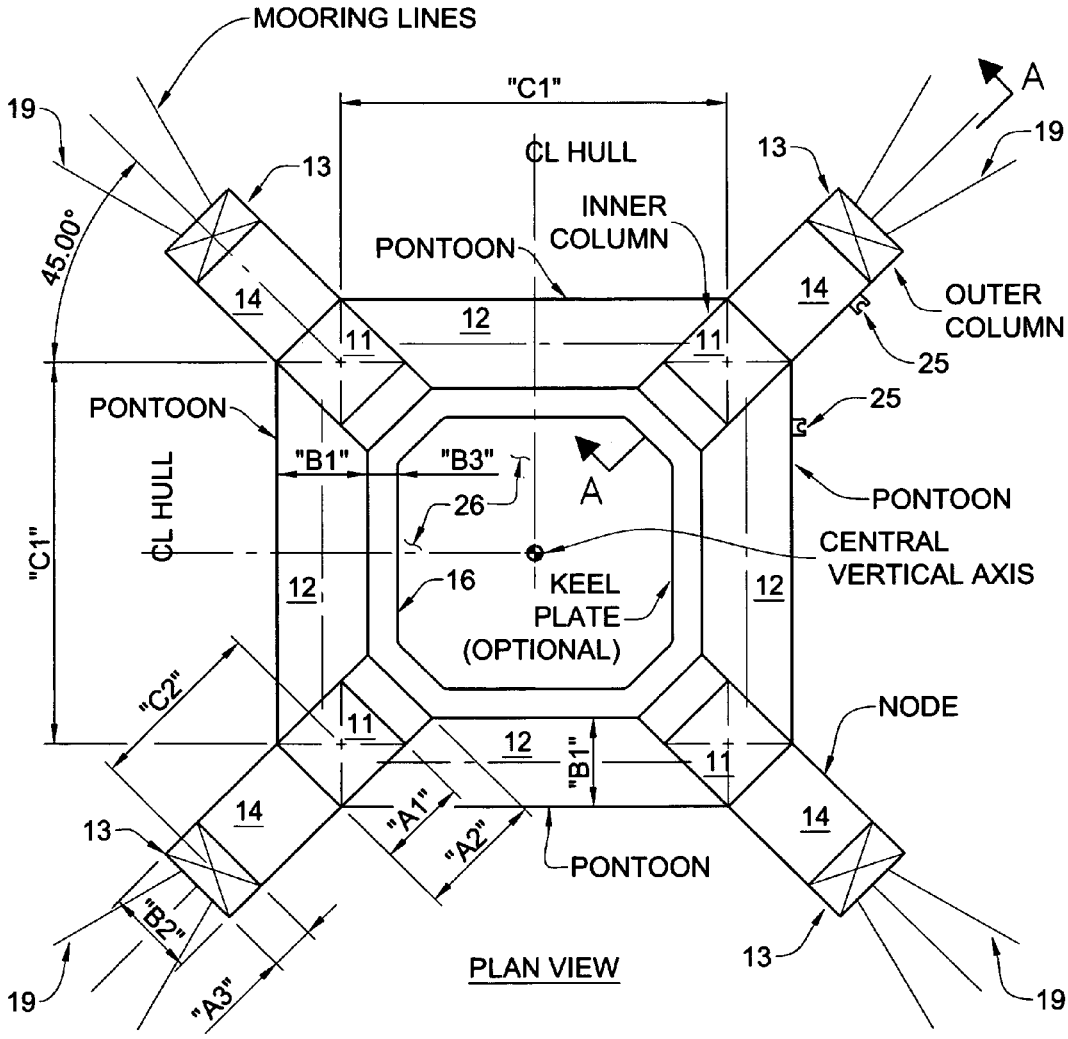
FIG. 2 presents a plan view of one embodiment of the present invention.
Figure 3:
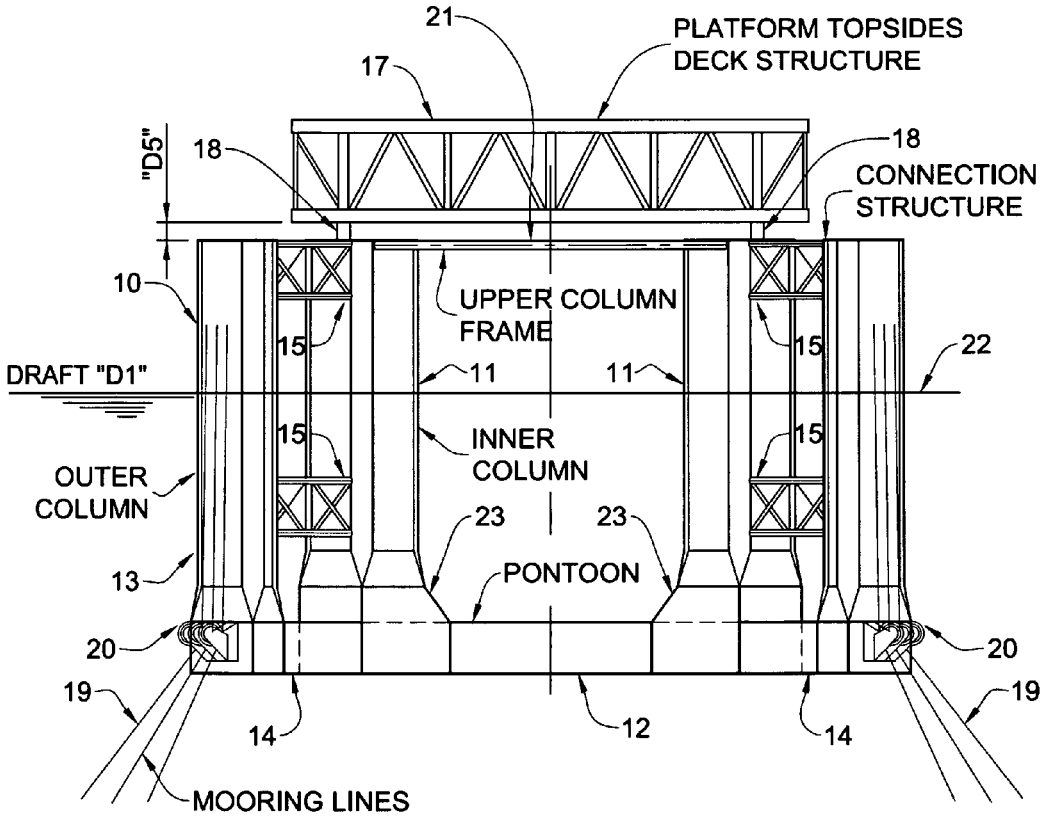
FIG. 3 presents an elevation view of one embodiment of the present invention.
Figure 4:
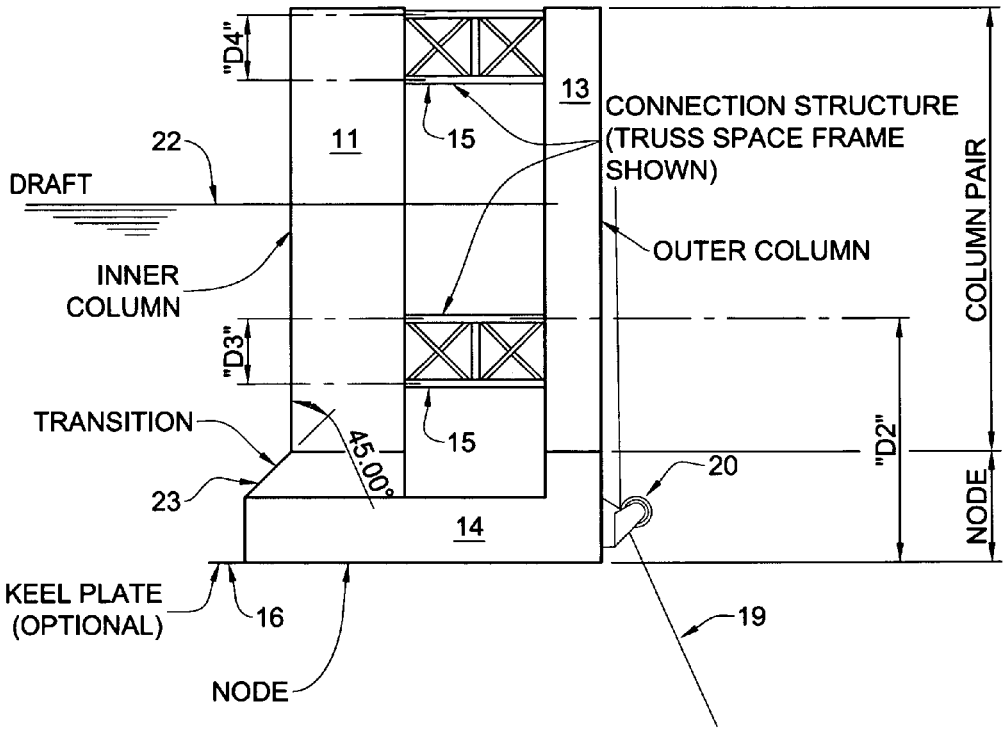
FIG. 4 presents an elevation view of one corner of the embodiment of the present invention shown in FIGS. 2, 3 and 7.
Figure 5:
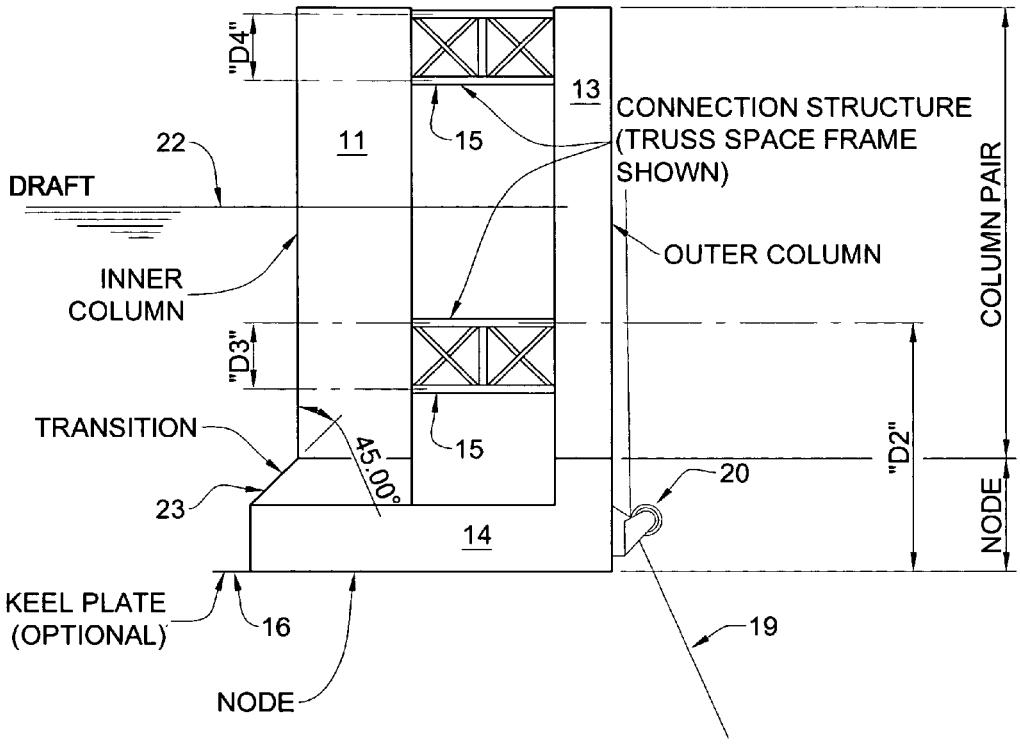
FIG. 5 presents a cross section view at the water line of the embodiment of the present invention shown in FIGS. 2, 3 and 7.
Figure 7:
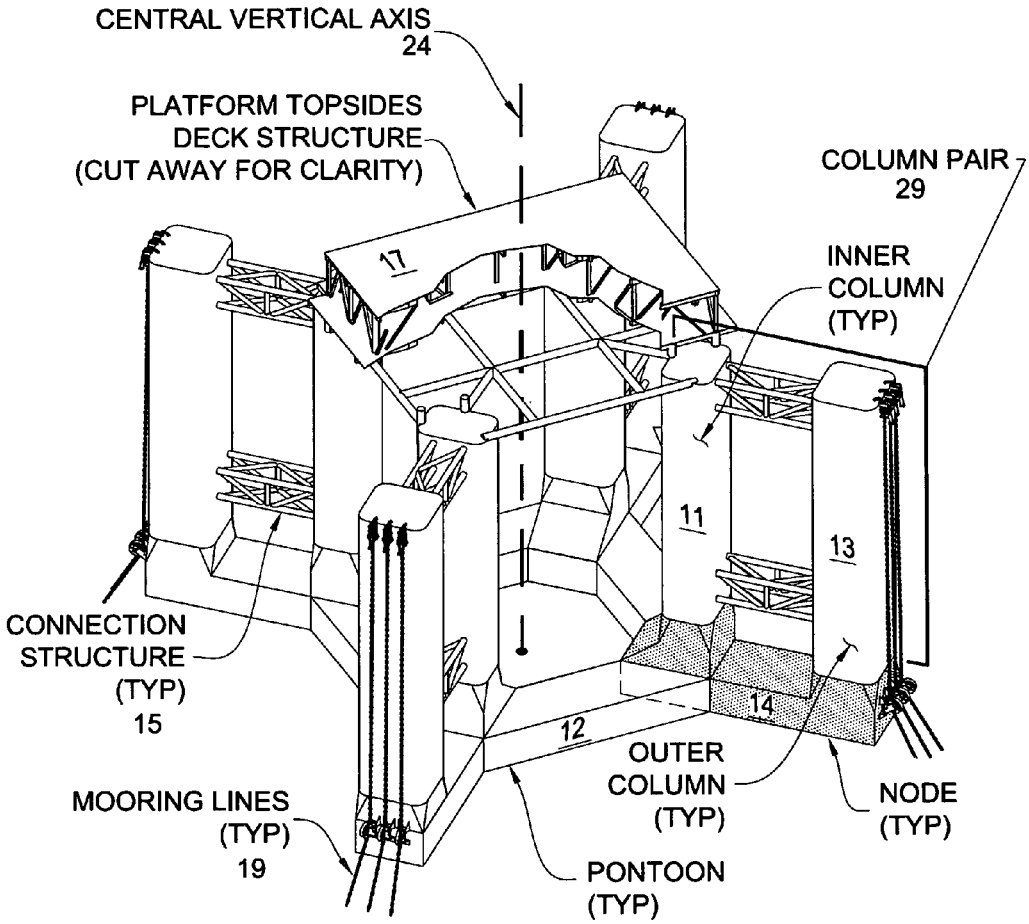
FIG. 7 presents an isometric view of one embodiment of the present invention.

The embodiment shown in FIGS. 2, 3 and 7 show the pontoons 12 connected to the connecting nodes 14. The structural connection between the inner and outer columns could easily be comprised only of a plurality of truss members, a single buoyant connection, a plurality of buoyant connections or a combination of truss members and buoyant connections.

Arranging the columns in pairs enables the benefits of hydrodynamic force cancellation and a reduction in hull and deck steel weight. Optimizing this benefit requires consideration of important characteristic dimensions which are identified in FIGS. 2 through 5. The dimensional parameters are defined as follows:

A1: length of inner column side, upper part. For a square inner column, A1=B2.

A2: length of inner column side, base part. This length depends on the pontoon width B1 according to the relationship A2=B1*sqrt (2) for this embodiment.

A3: length of outer column side. A3 optimally can vary from approximately 0.5A1 to 3.0A1.

B1: pontoon width.

B2: node width.

B3: keel plate width. B3 optimally can be varied from approximately 0.2B1 to 0.5B1.

C1: distance between the centers of two adjacent inner columns.

C2: distance between the centers of an inner column and an outer column in a pair of columns.

Dl: platform draft. For wet tree applications, the design draft is typical in the range of 80 ft to 120 ft. For dry tree applications, the design draft is typically in the range of 100 ft to 200 ft.

D2: the distance of the lower connection structure from the platform keel.

D3: the height of the lower connection structure.

D4: the height of the upper connection structure.

D5: the distance between the top of the inner column and the bottom of the lower deck.

According to the first design objective of this invention, the centerline spacing of the inner columns (C1) will be determined by the requirements of optimizing the deck structural design. The weight of the deck structure is lower if the deck supports are closer together. The stability requirement of the platform will be satisfied by a combination of factors:

(a) adjusting the distance (C2) between the inner column and outer column (b) adjusting the outer column dimension (A3 or B2), and (c) a combination of (a) and (b).

Thus, the design requirements of deck support optimization and in-place and pre-service stability have been de-coupled. For the same payload requirements, the deck structure will be lighter and the total displacement of the hull will be reduced, resulting in cost savings during fabrication. The benefit of deck support optimization is applicable for both wet tree and dry tree applications, however the benefit will be even more significant for dry tree solutions in which riser tension and drilling facilities are supported near the center of the deck structure.

In addition, the inner column side length at the lower part of the column A2 can be determined by the pontoon width B1 to achieve (a) adequate heave added mass and the desired heave natural period and (b) adequate buoyancy for maximum allowable draft for operations prior to installation such as wet tow and/or float off after dry transportation.

An inner transition column 23 can be used to de-couple the dependencies of the inner column side length and the inner column base side length.

Mooring equipment can optimally be placed on the top of the outer column. For embodiments where the deck structure 17 does not extend over the outer column 13, a very short deck connection 18 between the inner column 11 and the deck structure 17 results in a lower vertical center of gravity for the entire deck and the associated benefit in platform stability and motions.

Based on the above mentioned de-couplings, this invention provides the maximum flexibility for the designer to optimize the system design.

According to the second design objective of the invention, sufficiently small vertical motion characteristics can be achieved by (a) increasing the draft of the platform (D1), (b) minimizing the water plane area by adjusting dimensions A1, A3 and B2 to minimize hydrostatic stiffness, (c) combination of (a) and (b).

The outer column is more effective at providing stability for the platform because the distance from the center of the platform is increased and the available moment of inertia is increased. This invention therefore provides adequate stability with less water plane area compared to other semisubmersibles, which improves heave motion. Deck weight reduction as described previously also improves stability.

According to the third design objective of the invention, small surge motion characteristics in response to waves with wave periods from 6.0 to 9.0 seconds are critical to achieving acceptable fatigue performance for steel catenary risers attached to the substructure. For offshore applications in the oil and gas industry, steel catenary risers are employed to carry hydrocarbons to (import) and off of (export) floating platforms. Motions of the floating platform create fatigue damage in the riser, most significantly at the connection to the hull and at the touch down point at the sea floor. More recent oil and gas developments include reservoirs with high pressure, high temperature and the potential for souring of the well fluids, all of which contributes to risers that are more fatigue sensitive. Large diameter risers are also more sensitive to fatigue damage, especially in water depths of 4,000 ft or less.

Figure 1B:
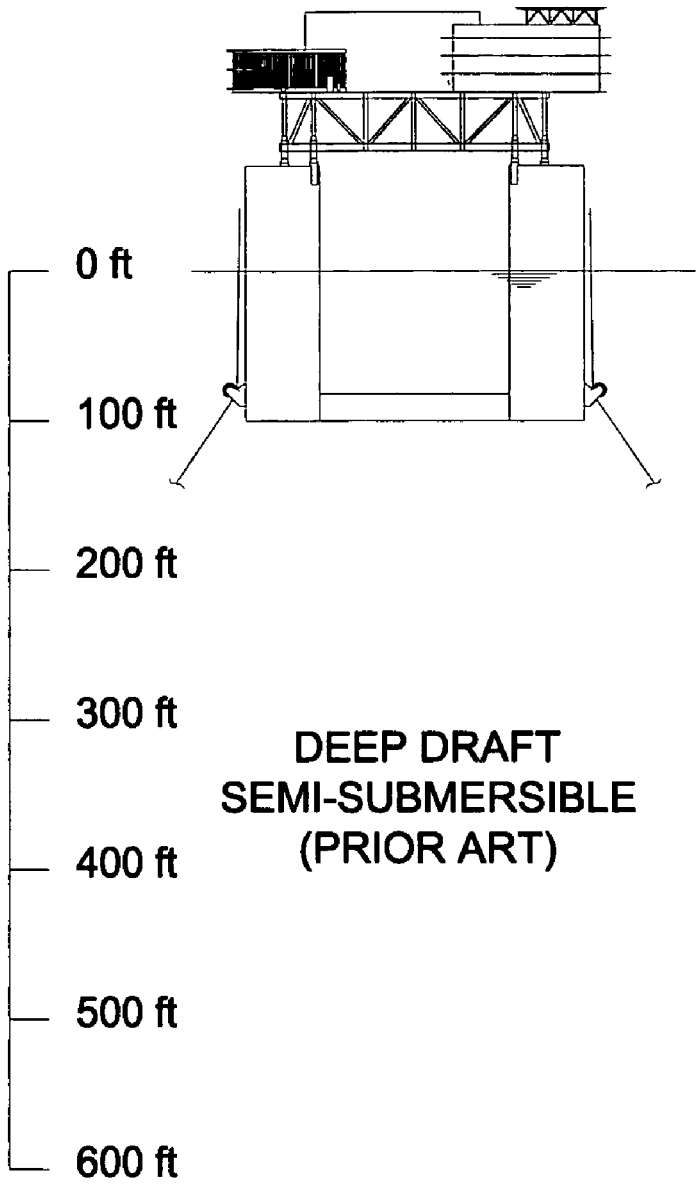
Figure 1C:
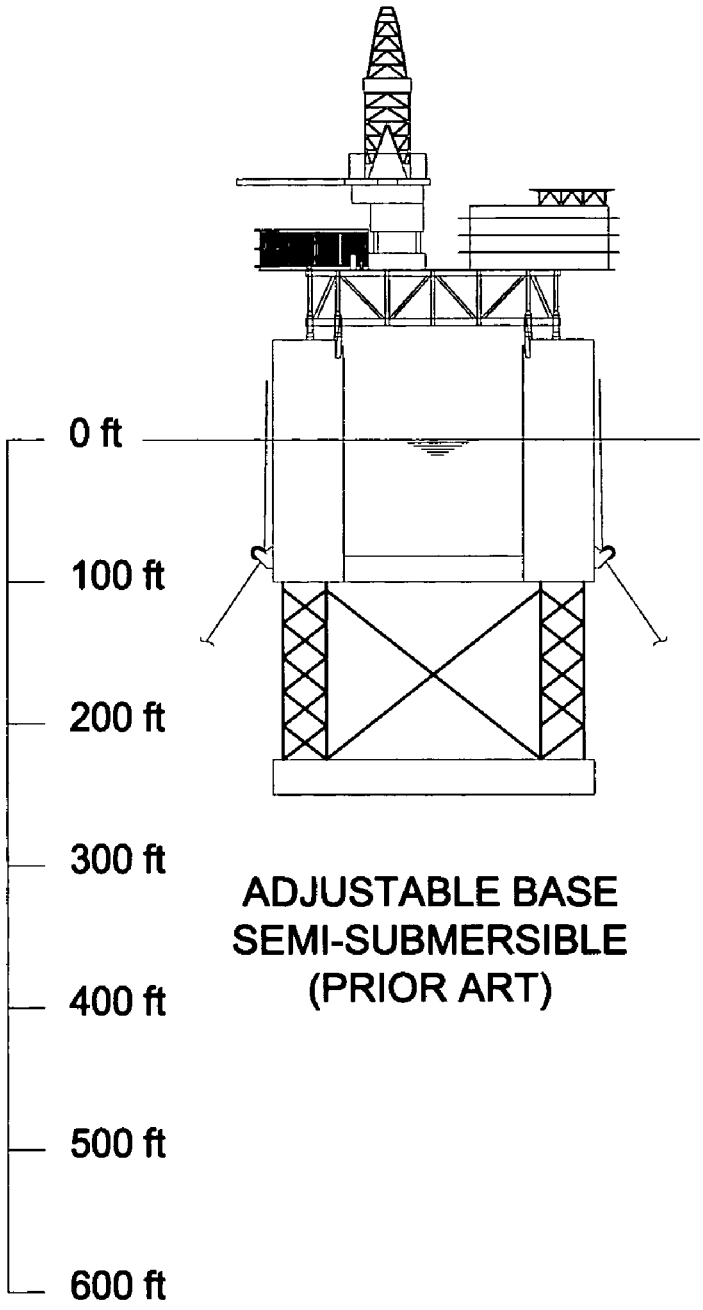
Figure 1D:
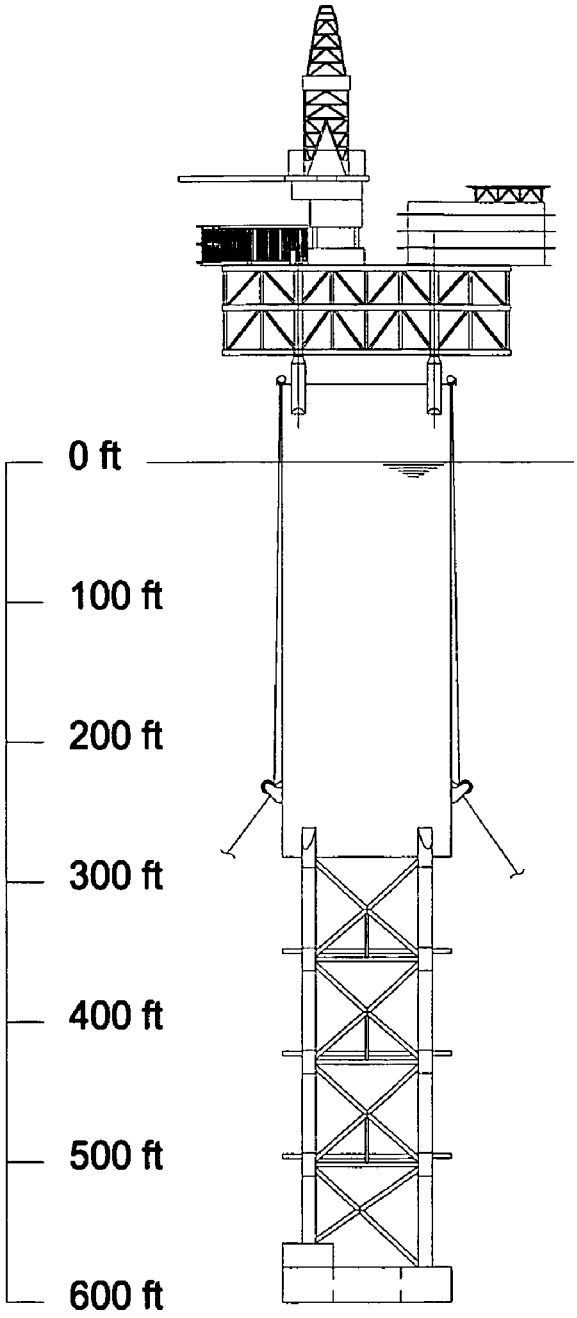
(PRIOR ART) Figure 1D
Figure 1E:
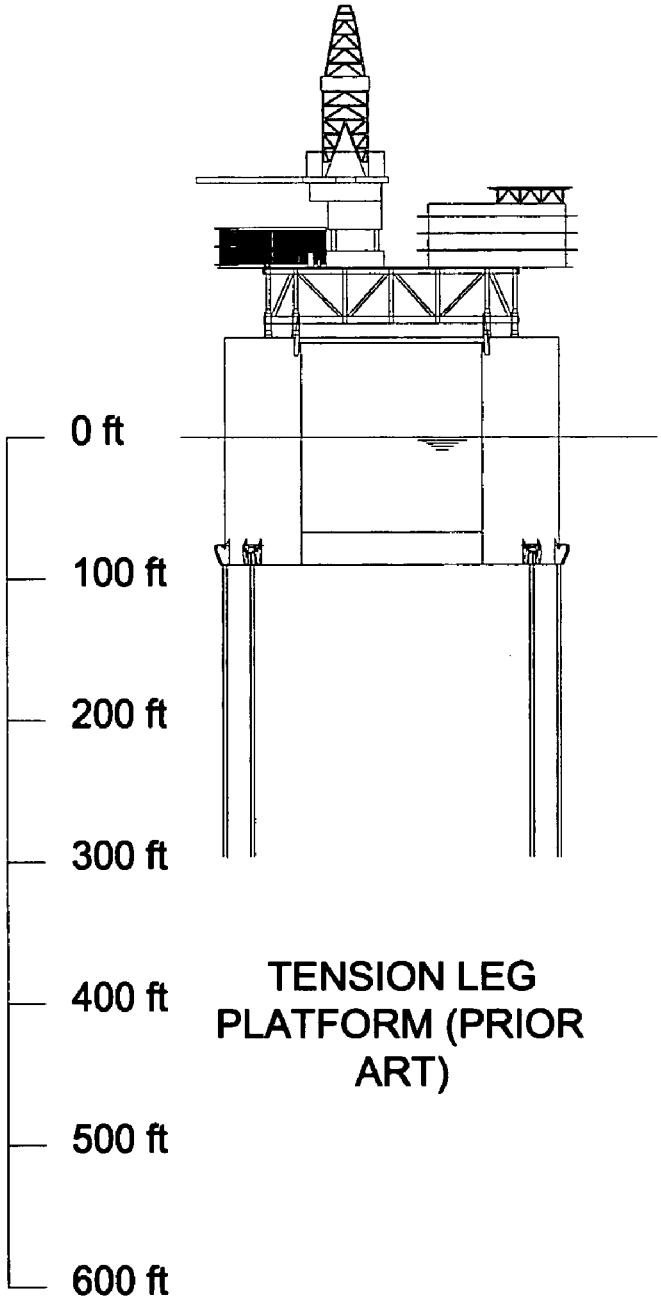
Figure 1F:
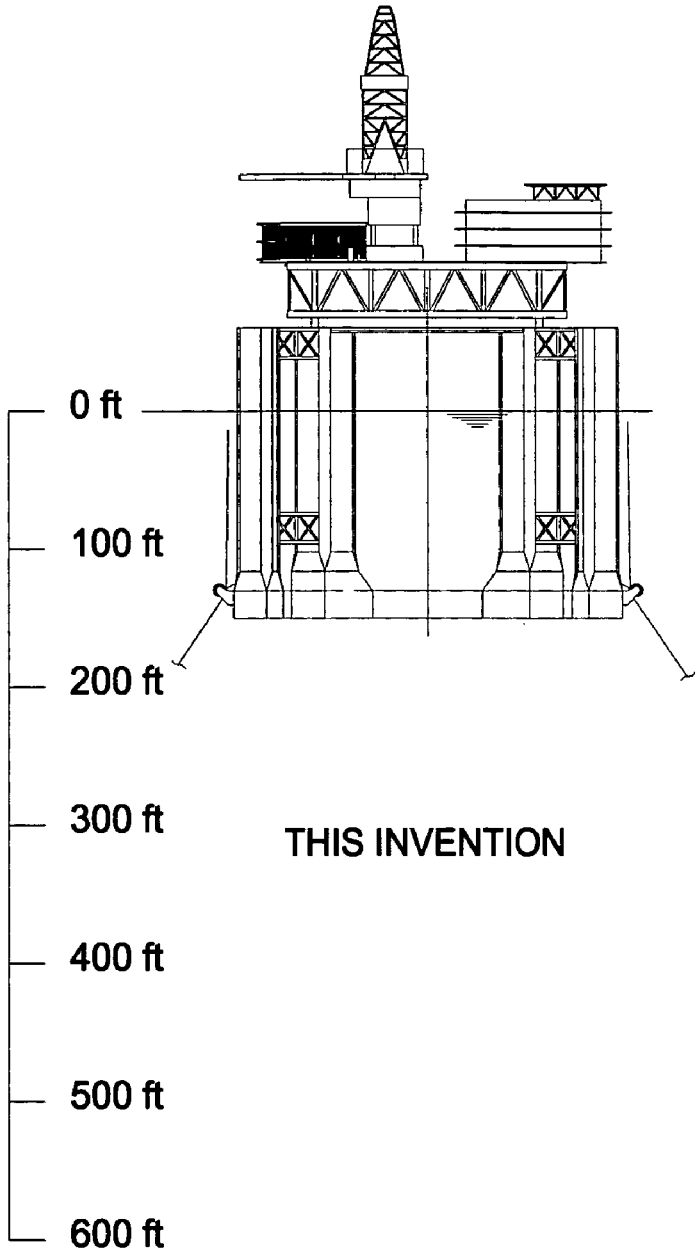

This invention will allow a tuning of the hydrodynamic cancellation effects between the columns and pontoon and will significantly reduce the surge motions for the wave periods around the target wave period ranges by as much as 45% when compared to the typical deep draft semi-submersibles (FIG. 1B).

In addition, since the cross-sectional areas of the inner column and outer column can be adjusted and are typically different, the vortex shedding induced natural frequencies are different. This feature may result in a cancellation or reduction of vortex induced motions in strong current conditions. Fatigue damage to the steel catenary risers due to vortex induced motions will therefore be reduced.

According to the fourth design objective of the invention, this invention will be able to allow a quayside integration option, which is not available with other concepts such as truss spars, which require the more costly and risky offshore integration operations. This invention can be constructed as a fully integrated platform with topsides and can be towed vertically to site.

According to the fifth design objective of the invention, this invention does not require hull structural components that move relative to each other, or extend, or deploy. The substructure disclosed is composed of simple structural elements without complex mechanisms.

According to the sixth design objective of the invention, the substructure draft 22 is typically in the range of 80 ft to 200 ft compared to more than 500 ft for a truss spar.

Figure 6:
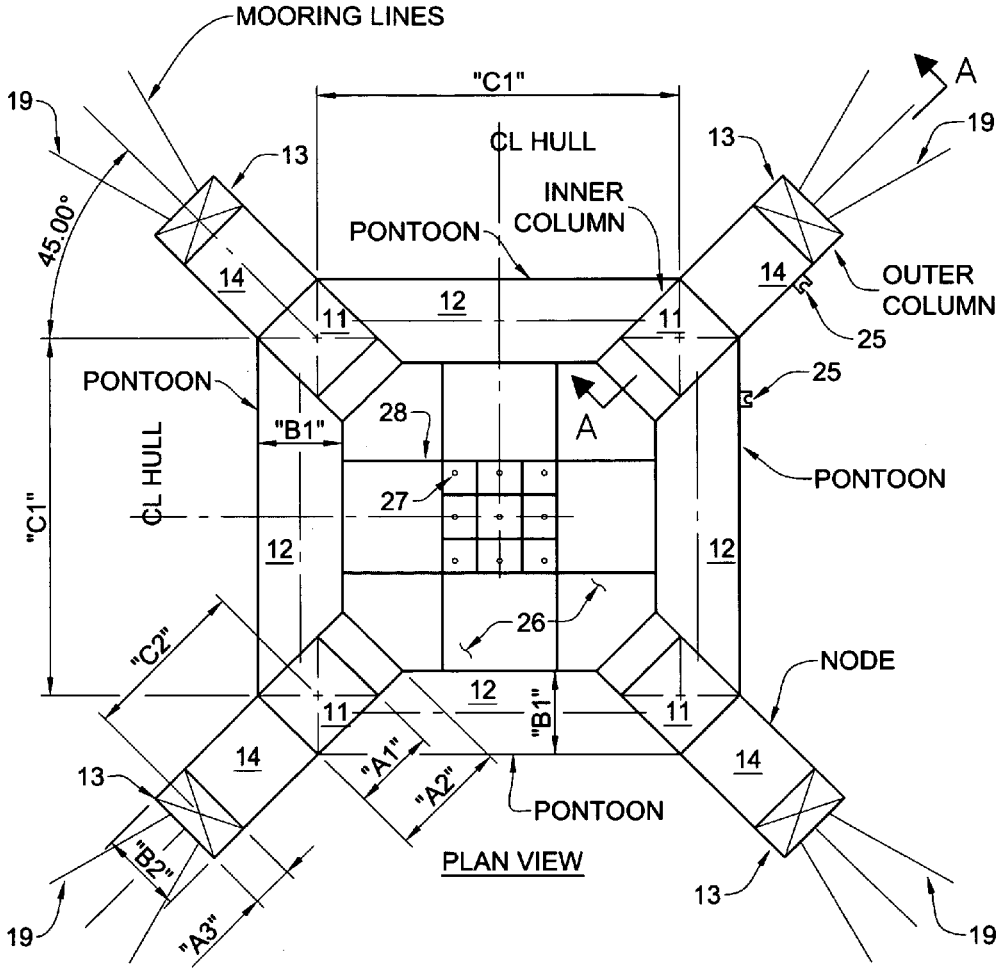
FIG. 6 presents a plan view of another embodiment of the present invention.

According to the seventh design objective of the invention, a conventional well bay design will be maintained for reliable drilling and riser operations. The embodiment shown in FIG. 2 has pontoons 12 with a central opening 26. The central opening allows for drilling operations to be performed through the pontoon. FIG. 6 shows an embodiment that includes top-tensioned production risers 27 for dry tree applications and said risers are located in the central opening of the pontoon. An optional riser guide frame 28 can be added to the pontoon level to avoid riser/pontoon clashing problems or to improve the relative motion between the surface trees on top of the risers and the deck. The motions of the dual column semisubmersible substructure will enable top-tensioned risers to be used with existing riser tensioner equipment, rather than requiring the development of costly equipment for extremely long riser strokes.

According to the eighth design objective of the invention, this invention is suitable for both wet tree and dry tree operations without water depth constraints such as with TLPs. The TLPs achieve small vertical motions using vertical moorings (tendons). When the water depth exceeds approximately 5,000 ft, the number of tendons and the tendon size requirements increase dramatically and the cost of the TLP may exceed economic limits for development. This invention adopts the chain-wire-chain or chain-polyester-chain mooring system for station keeping, conventionally used by many existing conventional semisubmersible and spar platforms. Thus, this invention can be employed in water depths of 10,000 ft and beyond.

This invention can also be achieved as a modification to an existing semisubmersible design. It is common practice to convert an existing semisubmersible originally designed for drilling operations into a production facility. It is also common practice to upgrade an existing semisubmersible for increased payload or water depth. For any such upgrade, modification or conversion, adding outer columns to the existing design, configured as described in the preceding text to achieve the benefits of efficient deck support, satisfactory stability, wave force cancellation, and/or other benefits mentioned above, would be another embodiment of this invention.

The dual column semisubmersible substructure is suitable for a variety of offshore applications, including but not limited to drilling, oil and gas production, combined drilling and production, power generation through alternate energy sources (e.g. wind or solar), accommodation, or other. This invention is suitable for oil and gas applications involving wet and/or dry trees and has many benefits previously disclosed when used with steel catenary risers, top-tensioned risers and/or other types of risers for transporting fluids to and from the platform.

Although the invention has been disclosed with reference to its preferred embodiments, from reading this description those of skill in the art may appreciate changes and modification that may be made which do not depart from the scope and spirit of the invention as described above and claimed hereafter.

I claim:

1. A semisubmersible substructure for offshore applications comprising: a plurality of columns arranged in pairs around a central vertical axis of the semisubmersible substructure, wherein each of the pairs of columns comprise an inner column and an outer column connected to one another by a connecting node, wherein the inner columns are buoyant and the outer columns are buoyant, wherein the inner columns, the outer columns, or both support a deck of the semisubmersible substructure, wherein each outer column is permanently secured to an adjacent inner column to provide stability and resist forces during installation and operation, wherein main pontoons connect adjacent lower ends of the pairs of columns to one another by way of connecting nodes, wherein each connecting node is disposed between the inner column and the outer column of an associated pair of columns, wherein each connecting node comprises at least one of a pontoon, a truss member, a buoyant connection, a plurality of buoyant connections, a plurality of truss members or a combination thereof; and a lateral mooring system configured to maintain a position of the semisubmersible substructure at a desired location, wherein the lateral mooring system comprises lateral mooring system equipment disposed on at least one of the outer columns and a chain-wire-chain, a chain, a chain-polyester-chain, or combinations thereof engaged with the lateral mooring system equipment.

2. The semisubmersible substructure according to claim 1 in which the individual columns or column pairs are vertical or inclined.

3. The semisubmersible substructure according to claim 1 in which the individual columns are circular in cross section.

4. The semisubmersible substructure according to claim 1 in which the individual columns are polygonal in cross section with square, rounded, or chamfered corners.

5. The semisubmersible substructure according to claim 1 in which the column pairs are oriented radially outward from the platform center or equidistant from the platform center.

6. The semisubmersible substructure according to claim 1 in which the column pairs are oriented in an arrangement to optimize hydrodynamic force cancellation and minimize platform motions.

7. The semisubmersible substructure according to claim 1 in which the pontoons are connected to each individual column or each column pair.

8. The semisubmersible substructure according to claim 1 in which a transition structure is used to connect the lower end of a column to the pontoon when the column cross section does not match the pontoon dimension where the column or pair of columns are connected to the pontoon.

9. The semisubmersible substructure according to claim 1 in which the means for maintaining position of the semisubmersible substructure above a desired location on the seafloor is connected to the columns without substantial restraint against substructure vertical and rotational motions such that the substructure is not heave-restrained.

10. The semisubmersible substructure according to claim 1 in which the upper ends of individual columns or column pairs are connected to a deck structure.

11. The semisubmersible substructure according to claim 10 in which the semisubmersible structure supports equipment for drilling, production, or drilling and production.

12. The semisubmersible substructure according to claim 10 in which the semisubmersible substructure supports wet tree wellheads, dry tree wellheads, or wet and dry tree wellheads.

13. A semisubmersible substructure for offshore applications comprising: a plurality of pairs of columns arranged around a central vertical axis of the semisubmersible substructure, wherein each of the pairs of columns comprise an inner column and an outer column, wherein the inner columns are buoyant and the outer columns are buoyant, wherein a space is formed between an entire length of each inner column and associated outer column, wherein at least one connecting node traverses the space and permanently secures each inner column to the associated outer column, wherein the inner columns, the outer columns, or both support a deck of the semisubmersible substructure, wherein each outer column is permanently secured to an adjacent inner column to provide stability and resist forces during installation and operation, wherein main pontoons with a central opening connect lower ends of adjacent pairs of columns to one another by way of connecting nodes, wherein each connecting node is disposed between the inner column and the outer column of an associated pair of columns, wherein each connecting node comprises at least one of a pontoon, a truss member, a buoyant connection, a plurality of buoyant connections, a plurality of truss members, or a combination thereof, and a lateral mooring system configured to maintain a position of the semisubmersible substructure at a desired location, wherein the lateral mooring system comprises lateral mooring system equipment disposed on at least one of the outer columns and a chain-wire-chain, a chain, a chain-polyester-chain, or combinations thereof engaged with the lateral mooring system equipment.

14. The semisubmersible substructure according to claim 13 in which the individual columns are vertical or inclined.

15. The semisubmersible substructure according to claim 13 in which the individual columns are circular in cross section.

16. The semisubmersible substructure according to claim 13 in which the individual columns are polygonal in cross section with square, rounded or chamfered corners.

17. The semisubmersible substructure according to claim 13 in which the column pairs are oriented radially outward from the platform center or equidistant from the platform center.

18. The semisubmersible substructure according to claim 13 in which the column pairs are oriented in an arrangement to optimize hydrodynamic force cancellation and minimize platform motions.

19. The semisubmersible substructure according to claim 13 in which the pontoons are connected to each individual column or each column pair.

20. The semisubmersible substructure according to claim 13 in which a transition structure is used to connect the lower end of a column to the pontoon when the column cross section does not match the pontoon dimension where the column or pair of columns are connected to the pontoon.

21. The semisubmersible substructure according to claim 13 in which the means for maintaining position of the semisubmersible substructure above a desired location on the seafloor is connected to the columns without substantial restraint against substructure vertical and rotational motions such that the substructure is not heave-restrained.

22. The semisubmersible substructure according to claim 13 in which the upper ends of the individual columns or column pairs are connected to a deck structure.

23. The semisubmersible substructure according to claim 22 in which the semisubmersible substructure supports equipment for drilling, production, or drilling and production.

24. The semisubmersible substructure according to claim 22 in which the semisubmersible substructure supports wet tree wellheads, dry tree wellheads, or wet and dry tree wellheads.

25. A semisubmersible substructure for offshore applications comprising: a plurality of columns arranged in pairs around a central vertical axis of the semisubmersible substructure, wherein each of the pairs of columns comprise an inner column and an outer column connected to one another by a connecting node, wherein each inner column is buoyant and each outer column is buoyant, a plurality of short deck connection securing a deck to the inner columns, wherein each outer column is permanently secured to an adjacent inner column to provide stability and resist forces during installation and operation, wherein main pontoons connect adjacent lower ends of the inner columns to one another, and wherein paired outer columns and inner columns are secured to one another by at least one connecting node disposed between a lower end and an upper end of the outer column, and a connection pontoon secured to the lower end of the outer column and the lower end of the associated inner column, wherein each connecting node comprises at least one of a pontoon, a truss member, a buoyant connection, a plurality of buoyant connections, a plurality of truss members, or a combination thereof, and a lateral mooring system configured to maintain a position of the semisubmersible substructure at a desired location, wherein the lateral mooring system comprises lateral mooring system equipment disposed on at least one of the outer columns and a chain-wire-chain, a chain, a chain-polyester-chain, or combinations thereof engaged with the lateral mooring system equipment and extending away from outer columns associated with the lateral mooring system equipment at an angle to a perpendicular vertical axis of the outer column.

* * * * *